US005584101A

United States Patent [19]

Brabant et al.

[11] Patent Number: 5,584,101

[45] Date of Patent: Dec. 17, 1996

[54] APPARATUS FOR REMOVING AND CONVEYING A FIBER WEB AT HIGH SPEED FROM THE OUTLET FROM A CARDER

[75] Inventors: Marc Brabant, Hem; Jean-Louis Dupont, Tourcoing, both of France

[73] Assignee: Thibeau (SA), France

[21] Appl. No.: 532,973

[22] Filed: Sep. 22, 1995

[30] Foreign Application Priority Data

Sep. 30, 1994 [FR] France ..... 94 11920

[51] Int. Cl.[6] ..... D01G 15/46; D01G 25/00; D01G 27/00

[52] U.S. Cl. ..... 19/304; 19/106 R

[58] Field of Search ..... 19/97.5, 106 R, 19/296, 298, 300, 301, 302, 304, 308

[56] References Cited

U.S. PATENT DOCUMENTS

| | | | |
|---|---|---|---|
| 3,787,930 | 1/1974 | Allen | 19/106 R |
| 4,274,178 | 6/1981 | Hotta | 19/106 R |
| 4,475,272 | 10/1984 | Wood | 10/106 R |
| 4,884,320 | 12/1989 | Gasser et al. | 19/106 R |
| 5,007,137 | 4/1991 | Graute | 19/304 X |
| 5,226,214 | 7/1993 | Napolitano | 19/296 |
| 5,361,451 | 11/1994 | Fehrer | 19/304 |
| 5,375,298 | 12/1994 | Nakamura et al. | 19/304 X |
| 5,442,836 | 8/1995 | Fehrer | 19/304 |

FOREIGN PATENT DOCUMENTS

| | | |
|---|---|---|
| 381960 | 12/1986 | Austria . |
| 282996 | 9/1988 | European Pat. Off. . |
| 0484812 | 5/1992 | European Pat. Off. . |
| 1500746 | 11/1967 | France . |
| 962162 | 7/1964 | United Kingdom . |

*Primary Examiner*—John J. Calvert
*Attorney, Agent, or Firm*—Ladas & Parry

[57] ABSTRACT

The device of the invention enables a fiber web at the outlet from a carder to be removed and conveyed at high speed without significant change to the structure of the web, and in particular without stretching the web. The device comprises a takeoff cylinder which is adjacent to the last working cylinder of the carder, suction means, and a conveyor belt. The belt of the conveyor is permeable to air, and at least level with the takeoff cylinder it possesses at least one rectilinear web-receiving portion that passes close to the takeoff cylinder with a linear speed that is substantially equal to the peripheral speed of the takeoff cylinder, travelling in a direction that is orthogonal to the axis of rotation of the takeoff cylinder, and interposed between the suction means and the takeoff cylinder. The suction means establish a suction zone between the takeoff cylinder and the rectilinear portion of the conveyor belt, substantially in the vicinity of the line where they are almost tangential.

12 Claims, 3 Drawing Sheets

APPARATUS FOR REMOVING AND CONVEYING A FIBER WEB AT HIGH SPEED FROM THE OUTLET FROM A CARDER

This application claims priority from French patent application No. 94 11920 filed Sep. 30, 1994. Said document is incorporated herein by reference.

The present invention relates to taking up and conveying a fiber web from the outlet from a carding engine or "carder". It mainly provides a device enabling a fiber web from the outlet of the last working cylinder of a carder to be removed and conveyed at high speed without giving rise to significant changes in the structure of the web, and in particular without stretching the web.

BACKGROUND OF THE INVENTION

At present, in order to remove a fiber web from the outlet from a carder, it is known to use a small diameter take off cylinder which is adjacent to the last working cylinder of the carder, and which is rotated to have the same speed and the same direction as the last working cylinder. The last working cylinder may be a comb cylinder, for example, having the function of causing the fibers of the web to be parallel, or it may be a condenser cylinder having the function of tangling together the fibers of the web so as to increase the cohesion of the web in a direction extending transversely to the working direction of the carder.

Two main types of takeoff cylinder are known. In a first type, the outer surface of the cylinder is designed to enable the fiber web to attach to the entire periphery of the takeoff cylinder, while nevertheless ensuring that the web attaches thereto more weakly than it attaches to the last working cylinder. It may be constituted, for example, by a cylinder fitted with an isosceles covering, or by a cylinder having longitudinal fluting over its entire periphery.

The second known type of takeoff cylinder consists in a perforated cylinder having a suction sector that is stationary facing the last working cylinder. One such takeoff cylinder is described, for example, in French patent No. 1 500 746. When the fiber web reaches the suction sector, it is pressed against the periphery of the rotating takeoff cylinder. Beyond the suction sector, the fiber web ought theoretically to adhere no longer to the periphery of the takeoff cylinder. In practice, rotation of the takeoff cylinder gives rise to a surface peripheral suction flow downstream from the suction sector thus tending to hold the fiber web on the cylinder, which means that in the absence of additional web takeup means, the web winds up on the periphery of the suction cylinder.

Compared with a suction takeoff cylinder, the first above-mentioned type of takeoff cylinder has the main advantage of enabling the fiber web to be taken up more reliably from the periphery of the working cylinder. However, the price of such reliability is that the fiber web adheres to the periphery of the takeoff cylinder more strongly than it does to the periphery of the suction takeoff cylinder, beyond its suction sector.

With both known types of takeoff cylinder, it is necessary to use additional means for taking up the fiber web in order to direct the web towards the following processing operation: this may be constituted, for example, by an operation of consolidating the fiber web by passing it between two calenders.

One known way of taking up the web from the periphery of the takeoff cylinder is to cause it to pass between two rotating cylinders, or between the belt of a conveyor and a rotating cylinder located immediately above the conveyor. With such means, takeup of the web is necessarily accompanied by the web being stretched lengthwise. Unfortunately, a fiber web at the outlet from a carder has very low cohesion, including very low resistance to a transverse traction force. Consequently, when such a web is stretched lengthwise, the cohesion of the web is correspondingly reduced. As a result, beyond a maximum working speed of the carder, which at present is about 120 meters per minute (m/min), web stretching becomes excessive and the resulting web is of poor quality as to appearance, uniformity of weight, and isotrophy of its mechanical properties.

Proposals have also been made in patent U.S. Pat. No. 3,787,930 to take up the fiber web from the periphery of the takeoff cylinder ("doffer"), by holding it down by suction against the surface of a conveyor belt. The system described in that patent thus uses a takeoff cylinder, suction means, and a conveyor belt which is interposed between the suction means and the takeoff cylinder, and in which the belt is permeable to air.

The intended object of implementing that system is to redirect the fibers of the web in random manner during transfer by suction from the takeoff cylinder onto the conveyor belt, thereby obtaining a web with scrambled-together fibers at the outlet from the carder. To this end, suction is provided in the zone where the fiber web is taken up by the takeoff cylinder, in which zone the web is subjected to a reversal of direction. The suction means thus create a zone of turbulence in the web reversal zone, thereby enabling the fibers of said web to become scrambled. In that system, it is necessary to cause the conveyor belt to pass through the zone where the web is taken up by the takeoff cylinder at the outlet from the carder. Consequently, the portion of the conveyor belt that is used for receiving the web cannot be a rectilinear portion and it is necessarily a curved portion. Specifically, it is constituted more particularly by a portion of a cylinder. Further, in the system of patent U.S. Pat. No. 3,787,930, in order to consolidate the web, the peripheral speed of the takeoff cylinder is preferably chosen to be greater than the linear speed of the conveyor belt by at least 20%.

OBJECT AND SUMMARY OF THE INVENTION

The object of the present invention is to propose a device which, unlike the above-mentioned prior art devices, makes it possible to remove and convey a fiber web from the outlet of a carder without changing the structure of the web, and in particular without causing the web to be stretched, thereby accelerating the throughput of the carder without degrading the quality of the resulting fiber web.

The above object is effectively achieved by the device of the invention which comprises in known manner, as disclosed in particular in patent U.S. Pat. No. 3,787,930, a takeoff cylinder which is adjacent to the last working cylinder of the carder, suction means, and a conveyor belt which is interposed between the suction means and the takeoff cylinder and which has a belt that is permeable to air.

According to the invention, the conveyor belt possesses a rectilinear portion for receiving the web, which portion passes close to the takeoff cylinder with a linear speed that is substantially equal to the peripheral speed of the takeoff cylinder and in a direction that is orthogonal to the axis of rotation of the takeoff cylinder; the suction means create a suction zone between the takeoff cylinder and the rectilinear portion of the belt at the almost-tangential line where they almost make contact tangentially, such that the fiber web is removed from the takeoff cylinder at the almost-tangential line and is placed on the rectilinear portion of the conveyor belt without being subjected to any significant alteration of its structure.

In the device of the invention, when the web reaches the suction zone created by the suction means between the takeoff cylinder and the rectilinear portion of the conveyor belt used for receiving the web, it becomes detached from the periphery of the takeoff cylinder under the combined effects of gravity and of suction, and it comes to rest unaltered on the surface of and in line with the conveyor belt. Since the conveyor belt is driven at substantially the same linear speed as the peripheral speed of the takeoff cylinder, the web is not subjected to lengthwise stretching.

Proposals have already been made in European patent application EP-A-0 484 812 to remove residual fibers from the surface of the last cylinder of a carder, which fibers remain after not being removed by mechanical systems situated upstream therefrom, the residual fibers being removed by being sucked against the surface of a rectilinear portion of a conveyor belt. However, the intended object of taking off the residual fibers is to change the orientation of the fibers so as to form a highly scrambled fiber web on the surface of the conveyor. To this end, the conveyor belt is driven in the opposite direction to the last cylinder of the carder, and the residual fibers are not taken up from the almost-tangential line between the cylinder of the carder and the conveyor belt.

In the device of the invention, the distance between the rectilinear portion for receiving the web and the periphery of the takeoff cylinder must be sufficiently small (about the thickness of the web) to ensure that while transfer is taking place the web is not subjected to fluttering that could damage it or give rise to transverse creases in the web. This distance must nevertheless be equal to not less than the thickness of the uncompressed web to ensure that the web is not also in contact with the periphery of the takeoff cylinder once it has been placed on the rectilinear portion of the conveyor belt.

In the device of the invention, when the web reaches the suction zone created by the suction means between the takeoff cylinder and the rectilinear portion of the conveyor belt used for receiving the web, it becomes detached from the periphery of the takeoff cylinder under the combined effects of gravity and of suction, and it comes to rest unchanged on said surface in line with the conveyor belt. Since the conveyor belt is driven at substantially the same linear speed as the peripheral speed of the takeoff cylinder, the web is not subjected to lengthwise stretching. The distance between the rectilinear web-receiving portion and the periphery of the takeoff cylinder must be small enough to ensure that while the web is being transferred it is not subjected to fluttering that could damage it or give rise to transverse creases therein. It is therefore preferable for this distance to be equal to or slightly greater than the thickness of the web. Nevertheless, the invention is not limited to this particular distance, given that it is possible, in practice, for the distance to be adjusted to take a value that may be as much as one hundred times the thickness of the resulting web without the web being subjected to damage that can be seen by the naked eye. Furthermore, with reference to a bottom limit for the distance, it has been possible to test values that are smaller than the thickness of the uncompressed web without that giving rise to a change in the appearance of the web. Under such circumstances, the suction flow created through the conveyor belt must be sufficient to compress the web enough in the region of the takeoff cylinder to ensure that the web is no longer in contact with the periphery of the takeoff cylinder once it has been placed on the rectilinear portion of the conveyor belt.

Advantageously, the distance between the rectilinear web-receiving portion and the periphery of the takeoff cylinder is adjustable so as to enable it to be adapted to different web thicknesses.

The suction flow which is created through the rectilinear portion of the conveyor belt must be sufficiently powerful to compensate for the adhesion of the fiber web to the periphery of the takeoff cylinder. This power depends on several parameters, including the weight of the resulting fiber web, the slope of the rectilinear web-receiving portion (relative to the horizontal), and the type of takeoff cylinder used.

Preferably, the suction zone created by the suction means has the following characteristics. It extends at least over the entire width of the web, thereby making it possible to avoid any danger of the longitudinal edges of the web folding while the web is being transferred between the takeoff cylinder and the conveyor belt; it begins at the almost-tangential line between the takeoff cylinder and the rectilinear web-receiving portion, or upstream from said almost-tangential line; and it extends downstream from the almost-tangential line over at least one radius of the takeoff cylinder. In the present text, the terms "upstream" and "downstream" are used relative to the displacement direction of the rectilinear web-receiving portion. The high speed rotation of the takeoff cylinder creates a suction flow downstream from the almost-tangential line between said cylinder and the rectilinear web-receiving portion that tends to hold the fiber web pressed against the periphery of the takeoff cylinder. Consequently, if the beginning of the suction zone is located downstream from said almost-tangential line, then the fiber web tends, beyond said almost-tangential line, to continue wrapping itself around the periphery of the takeoff cylinder and to move away from the suction zone. This gives rise firstly to the web being more difficult to detach from the periphery of the takeoff cylinder, and secondly for transfer of said web onto the conveyor belt (if that takes place beyond said almost-tangential line) to run the risk of allowing the web to flutter between the takeoff cylinder and the conveyor belt, thereby damaging the cohesion of the web. Turbulence effects, as created in particular by rotation of the takeoff cylinder downstream from the almost-tangential line, are felt mainly in the gap situated between the periphery of the takeoff cylinder and the rectilinear web-receiving portion, downstream from the almost-tangential line. That is why, in order to avoid any risk of the web being lifted off the surface of the conveyor belt, it is preferable to extend the suction zone from the almost-tangential line over a distance that is equivalent at least to the radius of the takeoff cylinder.

At the beginning of the suction zone, and when the zone is situated upstream from the almost-tangential line, it is essential for the suction flow to be prevented from disturbing takeup of the web from the working cylinder by the takeoff cylinder. Various solutions can be envisaged. It is possible to limit the power of the suction flow in the portion of the suction zone situated upstream from the almost-tangential line. It is also possible to interpose a deflector between the conveyor belt and the zone in which the web is taken up by the takeoff cylinder, thereby making it possible to prevent the suction flow reaching the web in the junction zone between the last working cylinder of the carder and the takeoff cylinder. Nevertheless, in order to avoid any risk of disturbance to web takeup from the working cylinder by the takeoff cylinder, it is preferable for the distance between the almost-tangential line and the beginning of the suction zone situated upstream from said line to be smaller than the radius of the takeoff cylinder.

Advantageously, the suction zone created by the suction means is not constant, with suction increasing continuously or quasi-continuously up to a maximum for the suction zone and then decreasing continuously to the end of the suction zone. Under such circumstances, the maximum suction in the suction zone is situated level with the almost-tangential line, or else downstream from said line, being remote therefrom by no more than the radius of the takeoff cylinder.

To obtain said non-uniform suction zone, it is preferable to use a suction box whose suction face situated facing the rectilinear portion of the portion of web is constituted by two converging inclined planes that are separated by a suction slot, which slot is disposed substantially orthogonally to the displacement direction of said rectilinear portion. The suction slot corresponds to the maximum suction zone, with the inclined planes making it possible to cause said suction to tail off, with a gradient that depends on the inclination on each of the planes.

When a carder includes at least two outlet paths each fitted with a device of the invention, it becomes very easy to superpose both webs on one of the conveyor belts of one of the devices. The present invention thus also provides a carder fitted at its outlet with at least two devices of the invention organized to enable the webs that come from their respective takeoff cylinders to be superposed.

In a first particular embodiment, the carder is fitted at its outlet with a single conveyor belt that is common to both devices.

In a second particular embodiment, each device possesses its own conveyor belt, with a first conveyor conveying a first web to the belt of the second conveyor so as to position the first web over and in line with the belt of the second conveyor; where the two belts meet, the second conveyor is fitted with suction means enabling the first web to be placed on the web conveyed by the second conveyor.

BRIEF DESCRIPTION OF THE DRAWINGS

Other characteristics and advantages of the invention appear from the following description of various particular embodiments of a carder fitted with two devices enabling each fiber web at the outlet from the carder to be removed and conveyed at high speed, the description being given by way of non-limiting example and being made with reference to the accompanying drawings, in which.

MORE DETAILED DESCRIPTION

Figure 1:
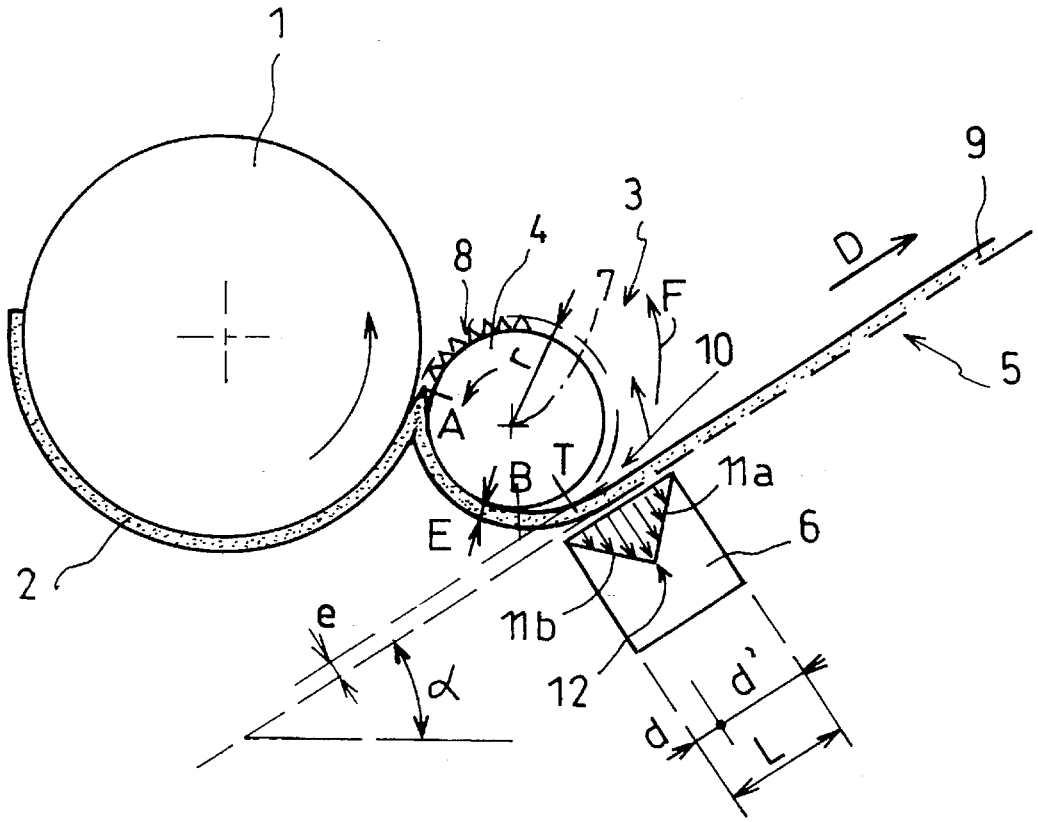
FIG. 1 is a diagram of the last working cylinder of a carder and of a device of the invention enabling a fiber web to be taken from the periphery of said working cylinder.

FIG. 1 shows the last working cylinder 1 of a carder, together with the device 3 that enables the fiber web 2 that is wound around the periphery of the working cylinder 1 to be removed and subsequently conveyed at high speed.

The device 3 is constituted by a takeoff cylinder 4, a conveyor belt 5, and a suction box 6. The takeoff cylinder 4 is adjacent to the working cylinder 1, and it is driven in the same direction of rotation and with the same speed about its axis of rotation 7. The periphery of said cylinder is provided with a cover 8 having isosceles spikes. The conveyor 5 has a belt with multiple perforations, and as a result it is permeable to air. The portion 9 of this belt that is shown in FIG. 1 is rectilinear, and it passes close to the periphery of the takeoff cylinder 4 in a direction which is orthogonal to the axis of rotation 7 of the takeoff cylinder. It is also driven in the same direction and at the same linear speed as the peripheral speed of the takeoff cylinder 4.

In the particular example of FIG. 1, the rectilinear portion 9 of the conveyor belt 5 slopes upwards at an angle $\alpha$ relative to the horizontal. This angle of slope is determined mainly by problems associated with the space occupied by the conveyor 5 relative to the main drum (not shown) of the carder, and it is related to the position of the working cylinder 1 relative to said drum, and also to the position of the takeoff cylinder relative to the working cylinder 1. It is therefore quite possible for the angle $\alpha$ to be zero, as illustrated in the carder shown in FIG. 2C.

The spacing between the rectilinear web-receiving portion 9 and the periphery of the takeoff cylinder, i.e. in this case the spikes of the cover 8, is represented in FIG. 1 by the distance e. Advantageously, the position of the axis of rotation 7 of the takeoff cylinder 4 is adjustable in a direction orthogonal to the rectilinear web-receiving portion 9, such that the distance e is adjustable as a function of the thickness of the web. The suction box 6 is positioned facing the takeoff cylinder 4 on the other side of the rectilinear portion 9 of the conveyor belt, and it establishes a suction zone 10 of width L between the takeoff cylinder 4 and the rectilinear portion 9 of the conveyor belt 5, which rectilinear portion 9 is almost tangential to the takeoff cylinder 4 along a line T referred to as the "almost-tangential" line.

In the particular example shown in FIG. 1, the suction zone 10 begins upstream at a distance d from the almost-tangential line T (upstream relative to the displacement direction D of the belt 9), and it extends downstream from said almost-tangential line over a distance d'.

When the web 2 comes into contact with the takeoff cylinder 4, it is removed from the periphery of the working cylinder 1 by the isosceles spikes of the cover 8 on the takeoff cylinder. Starting from point A, the web is thus transferred and adheres to the periphery of the takeoff cylinder 4. This adhesion is due in the present case mainly to the action of the isosceles spikes of the cover 8, however it is also due to the surface air flow generated at the periphery of the takeoff cylinder 4 when it is in rotation. This air flow is represented in FIG. 1, downstream from the almost-tangential line T, by means of arrows F.

A smooth cylinder could be used as a takeoff cylinder. Under such circumstances, adhesion would be due mainly to this superficial air flow. It is also possible, in the context of the present invention, to envisage using a perforated suction cylinder as the takeoff cylinder. The advantage of using a takeoff cylinder that has an isosceles cover or the like is that it increases the reliability with which the web is taken off by the cylinder. It should be observed that comparable reliability could be achieved with a takeoff cylinder having longitudinal fluting over its entire periphery.

Figure 3:
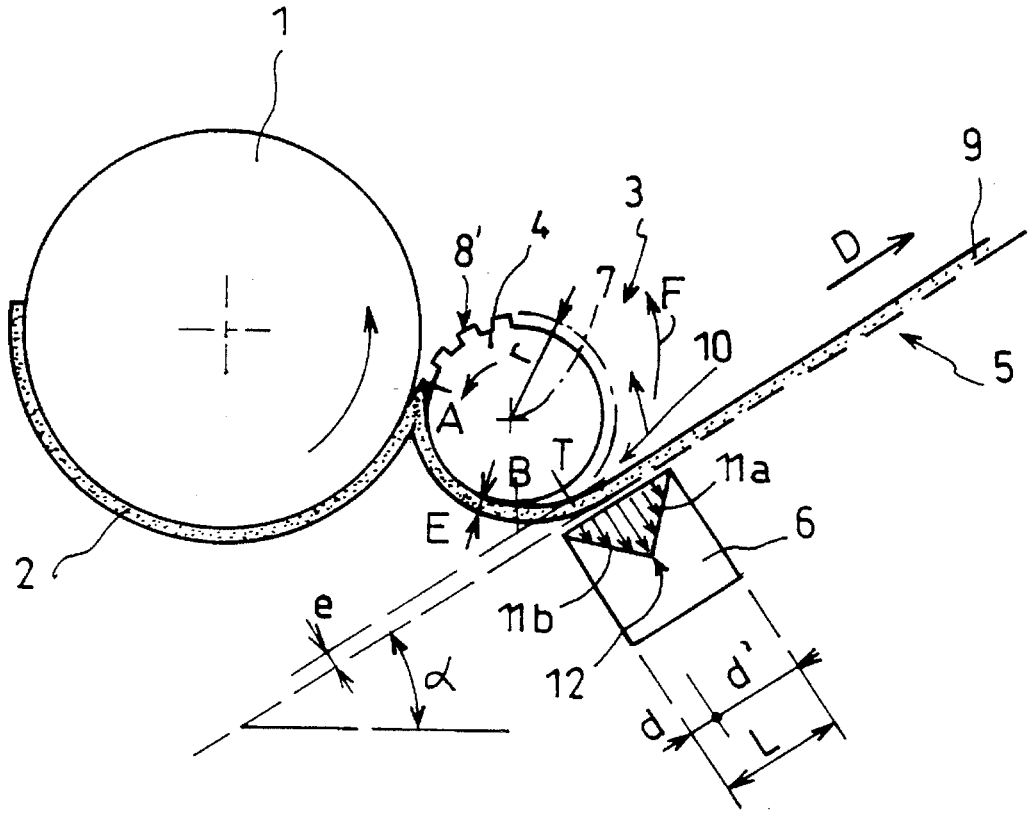
FIG. 3 shows a further embodiment of the invention having longitudinal fluting on the periphery of the takeoff cylinder.

FIG. 3 shows a further embodiment of the invention on FIG. 1 wherein the periphery of the takeoff cylinder has longitudinal fluting 8' instead of spikes 8 as in FIG. 1.

When the web 2 reaches the beginning of the suction zone 10, it begins to be removed from the periphery of the takeoff cylinder 4 at a point B, under the combined effects of gravity and of the suction flow created by the suction box 6 through the belt 9. As a result, the web 2 comes to rest on the belt 9 substantially at the almost-tangential line T and it is held on the surface of the belt 9 all the way to the end of the suction zone 10. The distance e must be small enough for the web 2 to be subjected to no deformation, in particular under the effect of its own weight or of the flow of air generated by rotation of the takeoff cylinder 4, while it is passing from the periphery of the takeoff cylinder 4 to the conveyor belt 5. It is important to emphasize that displacement of the conveyor belt 5 in the direction D also gives rise at the surface of said belt to a thin layer of air that is moving at the same speed and in the same direction as the belt. This thin layer of air and the suction flow generated by the takeoff cylinder 4 give rise to a zone of turbulence in the space between the takeoff cylinder 4 and the belt 9, upstream from their almost tangential line T, which zone of turbulence tends to lift the web 2 away from the belt 9. That is why it is preferable for the suction zone to extend far enough to ensure that the zone of turbulence is no longer felt, and why, in practice, it is preferable for the distance d' between the end of the suction zone 10 and the almost-tangential line T to be at least equal to the radius r of the takeoff cylinder 4.

Beyond this zone of turbulence, the fiber web is driven without slip relative to the surface of the conveyor belt 9 by the thin layer of air generated by the displacement of the belt. The speed of the web is thus identical to the speed of the conveyor belt. Since this speed is also identical to the peripheral speed of the takeoff cylinder 4, the fiber web is subjected to no stretching. It should be observed that in practice it is possible to accept speed variation of as much as 2% between the linear speed of the conveyor and the peripheral speed of the takeoff cylinder without that amount of variation giving rise to any change in the structure of the web that is detrimental to the quality and the cohesion of the resulting web.

In the particular example of FIG. 1, the suction box 6 has a suction face constituted by two converging inclined planes 11*a*, and 11*b*, which substantially form a V-shape and which are separated by a suction slot 12 lying in a direction that is orthogonal to the displacement direction D of the rectilinear portion 9 of the conveyor belt 5. This suction face preferably extends over the entire width of the web 2 so that the suction zone between the conveyor belt and the takeoff cylinder 4 extends to the margins of the web. The suction box 6 serves to establish a zone of varying suction, with suction increasing from point B up to a maximum that is level with the suction slot 12, and then decreasing down to the end of the suction zone. The speed of the suction flow generated by the suction box through the rectilinear portion 9 of the conveyor belt 5 is thus at a maximum at a position level with the suction slot 12.

It will be understood from the above description of the transfer of a fiber web from the takeoff cylinder 4 to the rectilinear portion 9 of the conveyor 5, that the suction zone 10 must make it possible at least to compensate for the adhesion of the fiber web to the periphery of the takeoff cylinder 4, and also for the effects of the turbulence created downstream from the almost-tangential line T. The characteristics of this suction zone depend mainly on the type of takeoff cylinder used, on the weight of the fiber web in question, and on the angle of inclination α of the rectilinear portion 9.

In a particular embodiment, the radius r of the cylinder having the isosceles cover was about 80 mm; the suction box 6 was positioned in such a manner that the distance d was about 20 mm, and the distance d' was substantially equal to the radius r; the speed of the suction flow, measured between the takeoff cylinder 4 and the rectilinear portion 9 level with the suction slot 12 lay in the range 1 meter per second (m/s) to 2 m/s; the angle α was free to vary in absolute value over the range 0° to 90°; and the distance e was adjustable over the range 0 mm to 50 mm. By implementing this particular embodiment, it was possible to remove and convey a web from the outlet of a carder for webs having a weight lying in the range 50 grams per square meter (g/m$^2$) to 100 g/m$^2$, and it was possible to do so at a speed of up to 300 m/min, while nevertheless conserving isotrophic mechanical properties for the web. As an indication, the thickness E of the web for a weight of 10 g/m$^2$ was about 5 mm.

In the context of the invention, it is naturally possible to replace the above-described suction box 6 with any type of appropriate suction means. More particularly, it is possible to envisage using a suction box that creates a suction zone having different suction gradients upstream and downstream from the suction slot 12, which amounts to having different inclinations for the two converging planes 11*a* and 11*b*.

When the carder is started up, and until it has reached normal operating conditions, the fiber web it produces is of smaller thickness and of lower weight. Consequently, in order to avoid any risk of the fiber web wrapping round the periphery of the takeoff cylinder 4, it is possible when starting up the carder, and in the context of the invention, to increase the suction flow generated by the box 6 until the carder has reached normal operating conditions and the web it produces has the required characteristics of weight and of thickness.

Figure 2A:
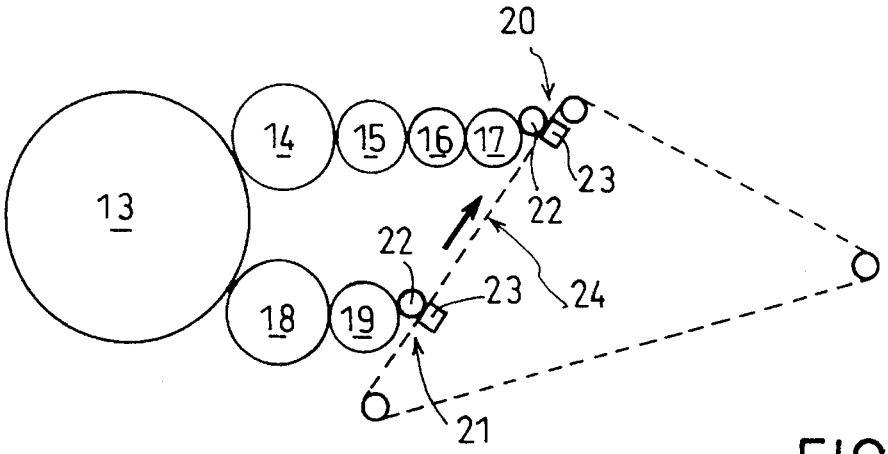
FIGS. 2A and 2B are diagrams of a carder fitted with two devices of the invention and sharing a common conveyor belt.
Figure 2B:
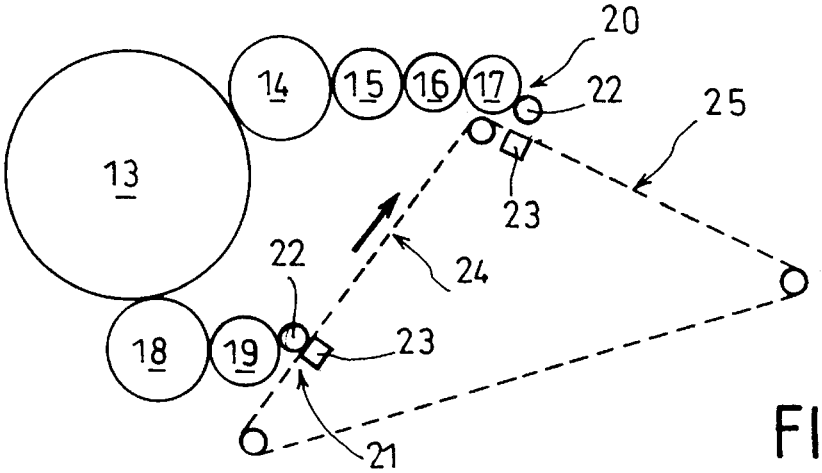
Figure 2C:
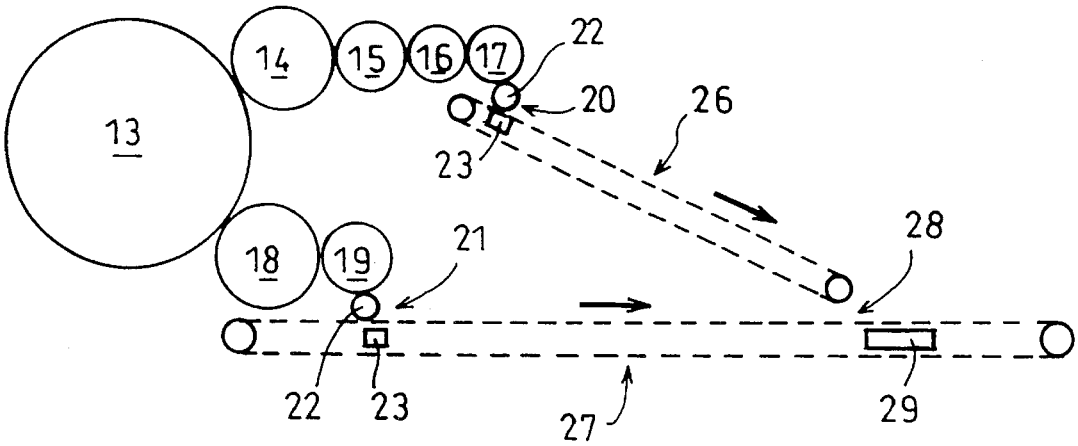
FIG. 2C is a diagram of a carder fitted with two devices of the invention each having its own conveyor belt, which conveyors are organized in such a manner as to enable the two webs coming from the carder to be superposed.

FIGS. 2A, 2B, and 2C show three possible examples of the outlet configuration from the carder enabling two fiber webs to be produced and to be superposed. In these figures, the main drum of the carder is given reference 13. The upper, first outlet path is constituted by a backing drum 14, a comber 15, and two successive condensers 16 and 17; the lower, second outlet path is constituted by a backing drum 18 and a combers 19. Each of these two outlet paths is fitted with a respective device 20 or 21 similar to that shown in FIG. 1. The takeoff cylinder and the suction box in each device are respectively referenced 22 and 23; the last condenser cylinder 17 in the upper path and the comber cylinder 19 in the lower path correspond to the working cylinder 1 of the device shown in FIG. 1.

In the two examples of FIGS. 2A and 2B, a single conveyor belt is used for both outlet paths. In the example of FIG. 2A, the conveyor belt has a rectilinear portion 24 which is used to receive both fiber webs from the two devices 20 and 21. Thus, the first fiber web from the lower path is conveyed by said rectilinear portion 24 to the inlet of the suction zone created by the suction box 23 of the device 20 associated with the upper path. In this suction zone, the second fiber web from the upper path is superposed on the first fiber web, with the suction flow established by the suction box serving both to hold the first fiber web from the lower path on the surface of the rectilinear portion 24 and to remove the second fiber web from the upper path so as to superpose it on the first fiber web.

In the example of FIG. 2B, the takeoff cylinder 22 and the suction box 23 of the device 20 belonging to the upper outlet path are positioned on either side of the rectilinear portion 25 of the conveyor belt, immediately downstream from a change in the direction of the belt of said conveyor. This variant embodiment has the advantage of avoiding any risk of the fiber web becoming unstuck when the conveyor changes direction. When the first fiber web from the lower path reaches this change of direction, it is held against the surface of the conveyor because of the presence of the suction box 23 immediately downstream from the change in direction.

In the third example of FIG. 2C, each device 20 and 21 has its own conveyor belt 26, 27. The takeoff cylinder 22 in each of the devices 20 and 21 is situated substantially vertically below the condenser 17 and the comber 19, respectively. The conveyor 25 is horizontal. The conveyor 27 is inclined downwards and enables the fiber web from the upper path to be brought to the surface of and into line with the conveyor 27. The two fiber webs from the carder are thus superposed in a junction zone 28 between the two conveyors 26 and 27. In this junction zone 28, there are also provided additional suction means having the function firstly of holding the first fiber web from the lower path against the surface of the conveyor 27 while the two webs are being superposed, and secondly of placing the fiber web conveyed by the conveyor 26 on the conveyor 27.

We claim:

1. A device for removing and transporting at high speed a fiber web at an outlet of a carder having working cylinders, the device comprising: a takeoff cylinder rotatable about an axis, the takeoff cylinder being adjacent to the last working cylinder of the carder; suction means; and a conveyer belt, the conveyer belt being interposed between the suction means and the takeoff cylinder and the conveyer belt being permeable to air, wherein the conveyer belt includes a rectilinear portion for receiving the fiber web, the rectilinear portion passing close to the takeoff cylinder with a linear speed substantially equal to the speed of the periphery of the takeoff cylinder and in a direction orthogonal to the axis of rotation of the takeoff cylinder, and wherein the suction means create a suction zone between the takeoff cylinder and the rectilinear portion of the conveyer belt at an almost-tangential line defined by a location wherein the takeoff cylinder and the rectilinear portion of the conveyor belt are spaced at virtual tangential contact, such that the fiber web is removed from the takeoff cylinder at the almost-tangential line and is placed on the rectilinear portion of the conveyor belt while holding the structural integrity of the web significantly unaltered.

2. A device according to claim 1, wherein the distance between the periphery of the takeoff cylinder and the rectilinear web-receiving portion of the conveyor belt is adjustable.

3. A device according to claim 1, wherein the conveyor belt and the takeoff cylinder are positioned so that the distance between the rectilinear web-receiving portion of the conveyor belt and the periphery of the takeoff cylinder is equal to or slightly greater than the thickness of the web.

4. A device according to claim 1, wherein the suction means create a suction zone between the takeoff cylinder and the rectilinear web-receiving portion of the conveyor belt in which the suction zone extends over not less than the entire width of the web, begins at the almost-tangential line between the takeoff cylinder and the rectilinear web-receiving portion of the conveyor belt or upstream from said almost-tangential line relative to a displacement direction of the rectilinear web-receiving portion of the conveyor belt, and extends downstream from the almost-tangential line over not less than the radius of the takeoff cylinder.

5. A device according to claim 4, wherein the distance between the almost-tangential line and the beginning of the suction zone is less than the radius of the takeoff cylinder.

6. A device according to claim 4, wherein the suction means create a zone of non-constant suction in which the suction increases continuously or substantially continuously from the beginning of the zone up to a maximum, and then deceases continuously or substantially continuously down to the end of the suction zone.

7. A device according to claim 6, wherein the suction means comprise a suction box wherein the suction face facing the rectilinear web-receiving portion of the conveyor belt includes two converging inclined planes that are separated from each other by a suction slot which extends orthogonally to the displacement direction of said rectilinear portion of the conveyor belt.

8. A device according to claim 1, wherein the periphery of the takeoff cylinder is fitted with an isosceles cover, said cover enabling the web to be removed while using adhesion that is less than that of the web on the last working cylinder.

9. A carder, having a plurality of outlets, wherein at least two of the outlets are fitted with a device as claimed in claim 1, said devices being positioned so that the webs coming from the takeoff cylinder of each device can be superposed.

10. A carder according to claim 9, wherein the outlets fitted with a device are fitted with a single conveyor belt common to the devices.

11. A carder according to claim 9, wherein each device includes a conveyor belt, a first conveyor belt of a first device conveying a first web to a second conveyor belt of a second device so as to place the first web over and in line with the second conveyor belt, and wherein the second conveyor belt is fitted in a junction zone between the two conveyor belts with suction means enabling the first web to be placed on a web conveyed by the second conveyor belt.

12. A device according to claim 1, wherein the periphery of the takeoff cylinder has longitudinal fluting, said fluting enabling the web to be removed while using adhesion that is less than that of the web on the last working cylinder.

* * * * *